US010064471B2

(12) United States Patent
Massoni et al.

(10) Patent No.: US 10,064,471 B2
(45) Date of Patent: Sep. 4, 2018

(54) AIR OXIDATION HAIR DYE APPLICATION SYSTEM AND METHOD FOR COLORING HAIR USING THE SAME

(75) Inventors: Jack T. Massoni, New Fairfield, CT (US); Alan Olsson, Greenwich, CT (US); Peter Mackinson, Wyckoff, NJ (US); Kevin Chan, Lebanon, NJ (US)

(73) Assignee: COMBE INCORPORATED, White Plains, NY (US)

( * ) Notice: Subject to any disclaimer, the term of this patent is extended or adjusted under 35 U.S.C. 154(b) by 0 days.

(21) Appl. No.: 11/934,209

(22) Filed: Nov. 2, 2007

(65) Prior Publication Data

US 2009/0114237 A1 May 7, 2009

(51) Int. Cl.
*A45D 24/22* (2006.01)
*A45D 19/00* (2006.01)

(52) U.S. Cl.
CPC ..... *A45D 24/22* (2013.01); *A45D 2019/0091* (2013.01)

(58) Field of Classification Search
CPC ..... A45D 24/24; A45D 19/02; A45D 24/22; A45D 2019/0066; A61K 8/19; A61K 2800/51
USPC ..... 132/112–116, 208; 401/176–181, 171; 222/145.5, 145.6
See application file for complete search history.

(56) References Cited

U.S. PATENT DOCUMENTS 2,108,184 A * 2/1938 Wallenius ..... 132/116
2,122,715 A * 7/1938 Forte ..... 132/116
2,148,966 A * 2/1939 Schmidt ..... 132/116
2,819,723 A * 1/1958 Meyer ..... 132/116
2,897,826 A * 8/1959 Di Vito ..... 132/114
3,446,216 A 5/1969 Sala
3,961,635 A * 6/1976 Miya ..... 132/113
4,004,877 A * 1/1977 Saphir ..... A61K 8/19 8/410
4,297,098 A 10/1981 Dasher et al.
4,983,315 A 1/1991 Glogowski et al.
5,000,199 A 3/1991 Kuranski et al.
5,024,243 A * 6/1991 Snyder ..... 132/116
5,284,972 A 2/1994 Parker et al.
5,337,764 A 8/1994 McKay
5,472,642 A 12/1995 Gutierrez et al.
5,480,460 A 1/1996 Muraoka
5,482,058 A * 1/1996 Garconnet ..... A45D 24/26 132/115

(Continued)

FOREIGN PATENT DOCUMENTS

CA 2 108 354 A1 4/1994
CA 2 310 457 A1 6/1999

(Continued)

OTHER PUBLICATIONS

First Examination Report in Australian Application No. 2008318932 (dated May 9, 2012).

(Continued)

*Primary Examiner* — Rachel Steitz
(74) *Attorney, Agent, or Firm* — Fitzpatrick, Cella, Harper & Scinto

(57) ABSTRACT

An air oxidation hair dye application system and a method for coloring hair using this system are provided. The system includes a container holding the hair dye and a comb-shaped applicator mounted on the container.

28 Claims, 6 Drawing Sheets

(56) References Cited

U.S. PATENT DOCUMENTS

| | | | | |
|---|---|---|---|---|
| 5,693,854 | A | 12/1997 | Gutierrez et al. | |
| 5,909,737 | A * | 6/1999 | Ricco | 132/116 |
| 5,937,866 | A * | 8/1999 | Magharehi | 132/116 |
| 6,065,891 | A | 5/2000 | Rehman et al. | |
| 6,112,751 | A | 9/2000 | Bennett | |
| 6,286,518 | B1 | 9/2001 | Laporte | |
| 6,334,449 | B1 * | 1/2002 | Burrowes | B65D 81/3211 132/112 |
| 6,588,433 | B2 | 7/2003 | Asano | |
| 6,915,807 | B2 | 7/2005 | Choi | |
| 6,962,158 | B1 * | 11/2005 | Anguelo | A45D 24/22 132/113 |
| 6,968,849 | B2 * | 11/2005 | Vena et al. | 132/208 |
| 6,976,495 | B2 | 12/2005 | Vena et al. | |
| 7,040,507 | B2 * | 5/2006 | Koike et al. | 222/94 |
| 7,052,752 | B2 | 5/2006 | Iwatsubo et al. | |
| 7,244,277 | B2 | 7/2007 | Kleen et al. | |
| 7,261,108 | B2 * | 8/2007 | Dallianis et al. | 132/116 |
| 7,350,524 | B2 | 4/2008 | Kimura et al. | |
| 2003/0113286 | A1 * | 6/2003 | Geary et al. | 424/70.12 |
| 2003/0150067 | A1 * | 8/2003 | Morita et al. | 8/405 |
| 2004/0016064 | A1 | 1/2004 | Vena et al. | |
| 2005/0081871 | A1 | 4/2005 | Ramet | |
| 2005/0199254 | A1 * | 9/2005 | Kang, II | 132/114 |
| 2006/0243292 | A1 | 11/2006 | Roger | |
| 2006/0283471 | A1 * | 12/2006 | Kimura et al. | 132/112 |
| 2007/0235053 | A1 | 10/2007 | Morgenstern et al. | |

FOREIGN PATENT DOCUMENTS

| | | | |
|---|---|---|---|
| CN | 2130401 | Y | 4/1993 |
| CN | 1426281 | A | 6/2003 |
| CN | 2555687 | Y | 6/2003 |
| CN | 200962942 | Y | 10/2007 |
| DE | 8535532.1 | U1 | 4/1987 |
| DE | 102 18 502 | A1 | 10/2002 |
| DE | 202 09 251 | U1 | 10/2003 |
| DE | 103 02 200 | A1 | 5/2004 |
| EP | 0 317 542 | A2 | 5/1989 |
| EP | 0 399 133 | A1 | 11/1990 |
| EP | 0 509 382 | A2 | 10/1992 |
| EP | 0 516 102 | A1 | 12/1992 |
| EP | 523460 | A2 * | 1/1993 |
| EP | 1 442 735 | A1 | 8/2004 |
| EP | 0 687 292 | A1 | 9/2004 |
| EP | 1 639 911 | A2 | 3/2006 |
| EP | 1 839 521 | A1 | 10/2007 |
| GB | 879577 | A | 10/1961 |
| GB | 1 491 980 | A | 11/1977 |
| JP | 60-080707 | U | 6/1985 |
| JP | 62-109002 | U | 7/1987 |
| JP | 2-050226 | U | 4/1990 |
| JP | 7-024211 | U | 5/1995 |
| JP | 9-75127 | A | 3/1997 |
| JP | 9-313243 | A | 12/1997 |
| JP | 11-009330 | A | 1/1999 |
| JP | 2002-085146 | A | 3/2002 |
| JP | 2002-142852 | A | 5/2002 |
| JP | 2002-159324 | A | 6/2002 |
| JP | 2002-165630 | A | 6/2002 |
| JP | 2002-325621 | A | 11/2002 |
| JP | 2002-345544 | A | 12/2002 |
| JP | 2002362596 | A * | 12/2002 |
| JP | 2003-523238 | A | 8/2003 |
| JP | 2003-300570 | A | 10/2003 |
| JP | 2005-139133 | A | 6/2005 |
| JP | 2005-179191 | A | 7/2005 |
| JP | 2005-334559 | A | 12/2005 |
| TW | M303656 | U | 1/2007 |
| WO | 98/51183 | A1 | 11/1998 |
| WO | 00/49905 | A2 | 8/2000 |
| WO | 2004/010818 | A1 | 2/2004 |
| WO | 2007/141164 | A2 | 12/2007 |
| WO | 2007/141165 | A1 | 12/2007 |

OTHER PUBLICATIONS

Communication pursuant to Article 94(3) in European Application No. 08844171.2 (dated May 30, 2012).
Second Office Action in Chinese Application No. 200880114566.X (dated Sep. 24, 2012).
Decision of Rejection in Japanese Application No. 2010-532165 (dated Aug. 20, 2013).
Office Action in Japanese Application No. 2010-532165 (dated Mar. 19, 2013).
Third Office Action in Chinese Application No. 200880114566.X (dated Jun. 5, 2013).
Office Action in Chinese Application No. 200880114566.X (dated Feb. 26, 2014).
Office Action in Canadian Application No. 2,609,963 (dated Feb. 10, 2014).
Office Action in Canadian Application No. 2,609,963 (dated Oct. 14, 2014).
Office Action in ROC (Taiwan) Patent Application No. 097141246 (dated May 19, 2014).
Office Action in Mexican Application No. MX/a/2008/013758 (dated May 6, 2014).
Final Notification of Reason for Refusal in Japanese Application No. 2013-259893 (dated Nov. 10, 2015).
Office Action in (ROC) Taiwanese Application No. 097141246 (dated Mar. 2, 2015).
Summons to Attend Oral Proceedings in Opposition to European Patent No. 2 211 657 (dated Feb. 18, 2016).
Letter by Opponent in Opposition to European Patent No. 2 211 657 (dated Feb. 16, 2016).
Office Action in Canadian Application No. 2,609,963 (dated Mar. 30, 2016).
Patentee's Response to Notice of Opposition to European Patent No. 2 211 657 (dated Sep. 21, 2015).
J. F. Corbett, In the Chemistry of Synthetic Dyes, vol. 5, pp. 475-534 (1971).
Patentee's Submissions under Rule 116 EPC in Opposition to European Patent No. 2 211 657 (dated Sep. 9, 2016).
Declaration by Jack Massoni in Opposition to European Patent No. 2 211 657 (dated Sep. 8, 2016).
Letter by Patentee in Opposition to European Patent No. 2 211 657 (dated Oct. 5, 2016).
Declaration by John F. Corbett in Opposition to European Patent No. 2 211 657 (dated Oct. 4, 2016).
Letter by Opponent in Opposition to European Patent No. 2 211 657 (dated Sep. 8, 2016).
Decision Rejecting Opposition to European Patent No. 2 211 657 (dated Dec. 6, 2016).
Minutes of the Oral Proceedings in Opposition to European Patent No. 2 211 657 (dated Dec. 6, 2016).
Office Action in Mexican Application No. MX/a/2008/013758 (dated Nov. 15, 2013).
Office Action in Japanese Application No. 2013-259823 (dated Dec. 16, 2014).
Office Action in Canadian Application No. 2,609,963 (dated Jul. 8, 2015).
First Examination Report in Indian Application No. Application No. 2866/DELNP/2010 (dated Feb. 20, 2017).
Office Action in Canadian Application No. 2,609,963 (dated Nov. 10, 2016).
Notice of Opposition to European Patent No. 2 211 657 (dated Jan. 30, 2015).
Translation of Office Action in Chinese Application No. 200880114566.X (dated Dec. 2011).
Office Action in New Zealand Application No. 584584 (dated Jul. 2011).
Office Action in Canadian Application No. 2,609,963 (dated Aug. 7, 2017).

* cited by examiner

AIR OXIDATION HAIR DYE APPLICATION SYSTEM AND METHOD FOR COLORING HAIR USING THE SAME

BACKGROUND OF THE INVENTION

Field of the Invention

The present invention relates to an air oxidation hair dye application system and a method for coloring hair using this system.

Human hair is treated in diverse ways with various cosmetic preparations. The treatments include, for example, cleansing using shampoos, care and regeneration using rinses and treatments, as well as bleaching, coloring and shaping the hair using colorants, tints, waving compositions and styling preparations. Compositions for changing or nuancing the color of head hair, however, play a prominent role.

Colorants or tints that comprise so-called direct dyes as the coloring component are typically used for temporary colorations. These are dye molecules that attach directly to the hair and require no oxidative process to develop the color. One example of such a dye is henna, which has been used for hundreds of years to color both body and hair. Direct dyes are typically very sensitive to shampooing, which can be used to remove the dye from the hair.

For lasting, intense colorations with corresponding fastness properties, the so-called oxidation colorants are often employed. Such colorants typically comprise oxidation dye precursors, so-called developer components and coupler components. Under the influence of oxidizing agents or of atmospheric oxygen (air oxidation dyes), the developer components form the actual dyes with one another or couple with one or more coupler components. The oxidation colorants are characterized by excellent, long-lasting coloring results. For natural-looking colorations, a mixture of a relatively large number of oxidation dye precursors is typically used.

Oxidative hair colorants are formulated in the form of aqueous emulsions or coloring gels, which, if appropriate, are mixed directly prior to application with a separately formulated oxidizing agent preparation. Typically, they are packaged in hard or soft dispensers when sold to consumers. Currently available containers and dispensers for oxidative hair dyes, such as the container disclosed in U.S. Pat. No. 7,052,752, are designed to prevent the dyes from oxidizing during storage. However, since air oxidation hair dyes rapidly oxidize upon exposure to air, they can produce undesirable coloring results due to premature oxidation. The known currently available containers and dispensing systems are insufficient for preventing and/or minimizing such premature oxidation.

SUMMARY OF THE INVENTION

The present invention solves a premature oxidation problem that exists in the area of coloring hair using air oxidation hair dye compositions by providing a system and a method for immediate application of the dye to the hair. In particular, the present invention provides a system and method for directly and evenly applying the air oxidation dye to the hair with minimal exposure to air prior to contact with hair.

This system includes a container, an air oxidation hair dye composition in the container and an applicator mounted on the container. The applicator is in fluid communication with the inside of the container and is capable of receiving the dye composition from the container. In particular, the applicator is in the form of a comb-like structure that projects from a base and has an internal manifold that receives the dye from the container. A number of comb teeth project sidewardly from the applicator, thereby to define an applicator comb. Openings for dispensing the dye are formed in the applicator comb, preferably between adjacent comb teeth.

The container may be any suitable container capable of retaining an air oxidation hair dye composition. Preferably, the container is adapted to minimize premature oxidation of the dye during storage. For ease of application, the container is preferably a tube, which can be squeezed by the consumer to force the dye through the openings in the applicator. Accordingly, the dye is forced from the container through the openings in the applicator substantially immediately before being applied by the applicator to the hair. Therefore, premature oxidation of the dye prior to application to the hair is greatly reduced of minimized.

The method of coloring hair according to the present invention comprises applying the air oxidation hair dye composition using the above-described system. Preferably, the air oxidation hair dye composition is combed through the hair immediately after and/or during application to ensure uniformity of the coverage and to achieve better coloring results, and again to minimize or greatly reduce premature oxidation of the dye.

DESCRIPTION OF RELATED ART

DETAILED DESCRIPTION OF THE INVENTION

The present invention is related to an air oxidation hair dye application system and a method for coloring hair using this system. The present inventive system and method mitigate the existing problems associated with premature oxidation of the air oxidation hair dye that occurs when this dye comes into contact with air.

The system in accordance with the present invention includes a container, an air oxidation hair dye in the container and an applicator mounted on the container. The applicator is in fluid communication with the inside of the container and is capable of receiving the dye from the container. In particular, the applicator is in the form of a comb structure defining a comb that projects from a base and has an internal manifold that receives the dye from the container. A number of comb teeth project sidewardly from the applicator, defining an applicator comb. Openings for dispensing the dye are formed in the applicator comb, preferably between adjacent comb teeth.

Figure 1:
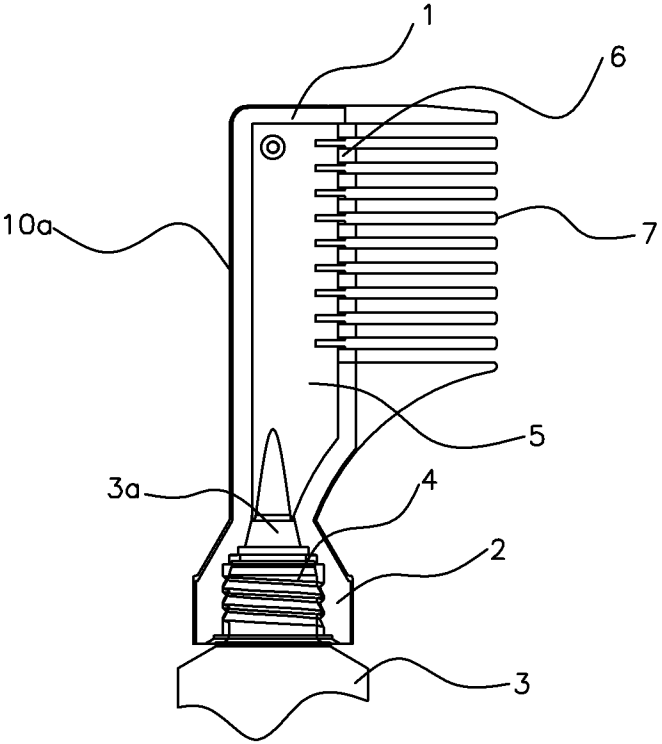
FIG. 1 is a side, cross-sectional view of an applicator comb structure in accordance with an embodiment of the present invention.

One embodiment of the applicator in accordance with the present invention is shown in FIG. 1. Specifically, the applicator 1 has a base 2 and is mounted on a container 3, which holds the air oxidation hair dye composition. In this embodiment, the applicator 2 is mounted on the container 3 via a thread 4. Other types of mounting, such as using a snap or an adhesive and the like, are also possible. Alternatively, the base may be molded to or with the container to form a unitary structure.

Figure 2:
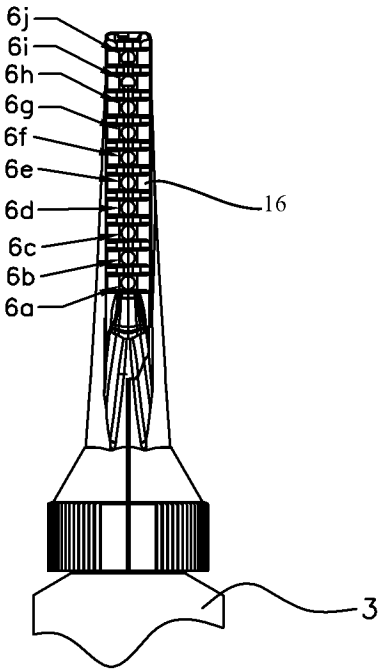
FIG. 2 is a front view of the applicator comb structure in FIG. 1.

The interior of the applicator shown in FIG. 1 is formed with a passage 3*a* that communicates with the threaded base and opens into a manifold 5 that communicates with separate openings 6, each of which is formed in the applicator between each of the inner ends of the respective comb teeth 7. The diameter of these openings is preferably from about 1.3 mm to about 1.9 mm, more preferable from about 1.5 mm to about 1.7 mm. The openings can have the same diameter or the diameter of each opening may differ, if desired. For example, as shown in FIG. 2, the five lowermost openings 6*a*-6*e*, each between a pair of the six lowermost comb teeth, may have a diameter of about 1.5 mm. The next three lower-most openings may have a diameter of about 1.7 mm and the remaining two openings may have a diameter of about 1.5 mm. The sizes of the respective openings between adjacent comb teeth may be determined to facilitate uniform distribution of the dye composition along the entire extent of the applicator comb.

Figure 3:
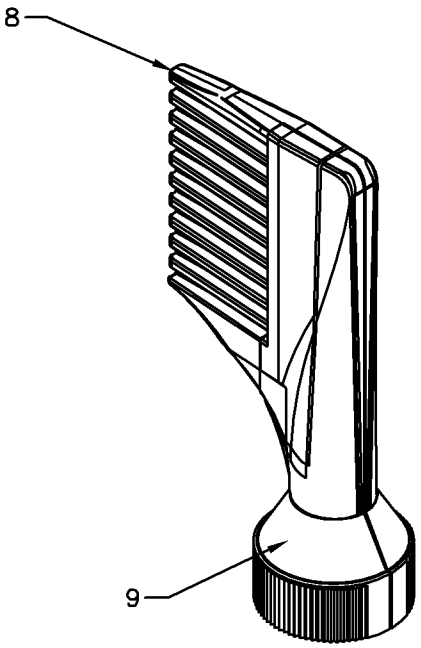
FIG. 3 is a perspective view of the applicator comb structure in FIGS. 1 and 2.
Figure 4B:
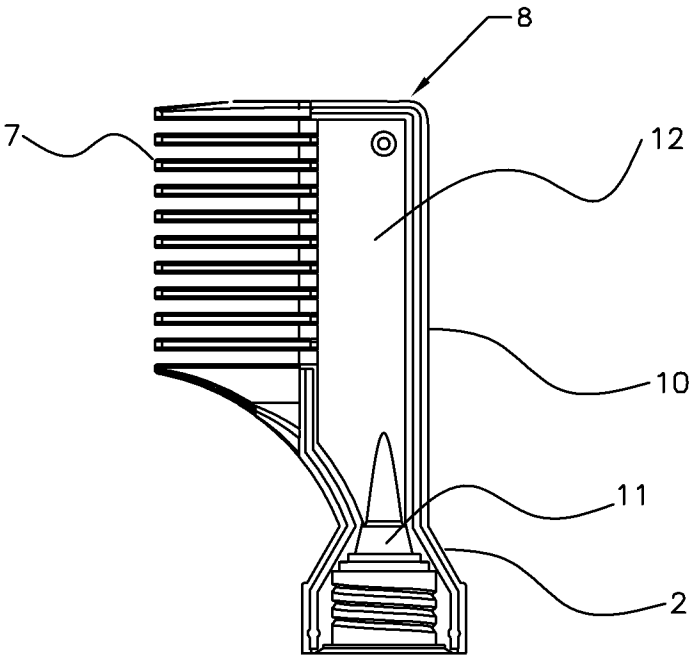
FIG. 4B is a side view of the first part of the applicator comb structure in FIG. 4A.
Figure 4A:
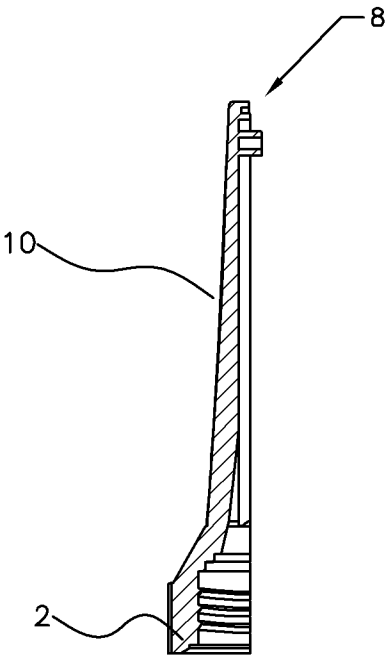
FIG. 4A is a back view of part one of an applicator comb structure in accordance with the present invention.
Figure 4C:
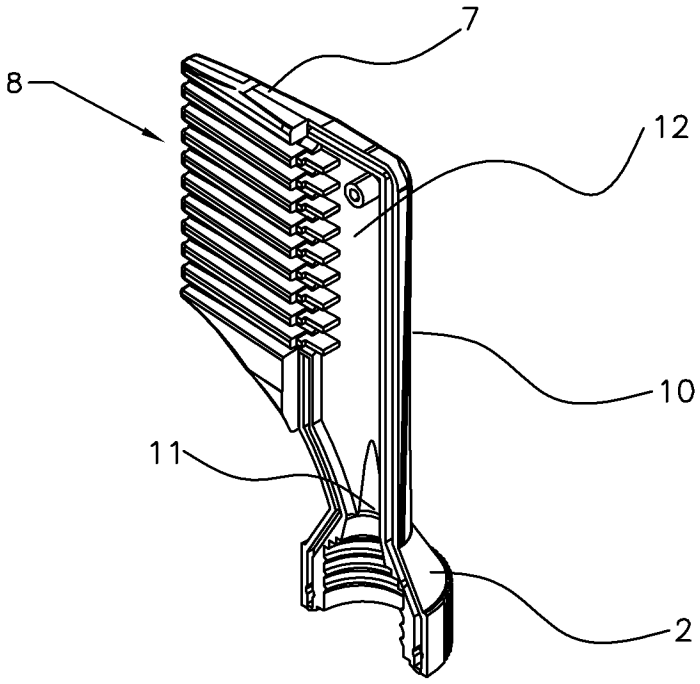
FIG. 4C is a perspective view of the first part of the applicator comb structure in FIGS. 4A and 4B.
Figure 5B:
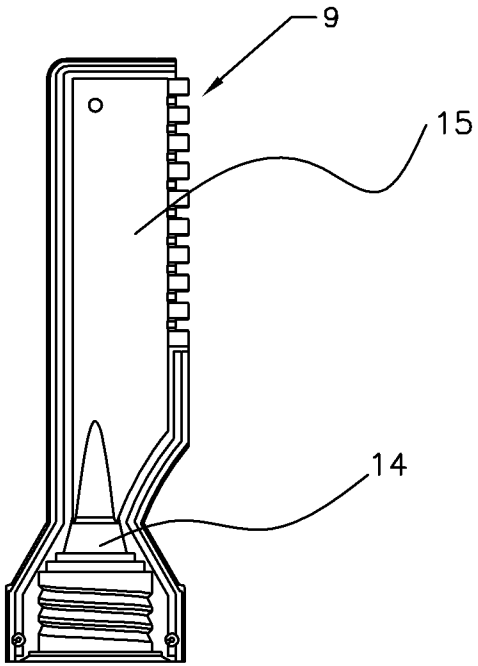
FIG. 5B is a side view of the second part of the applicator comb structure in FIG. 5A.
Figure 5A:
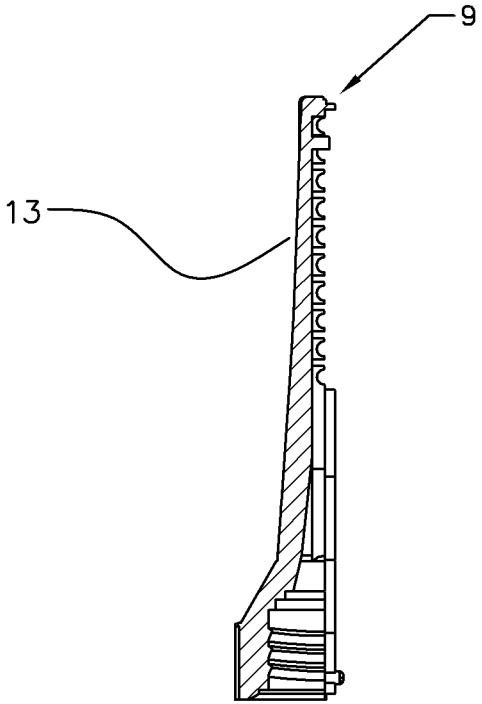
FIG. 5A is a back view of a second part of an applicator comb structure in accordance with the present invention.
Figure 5C:
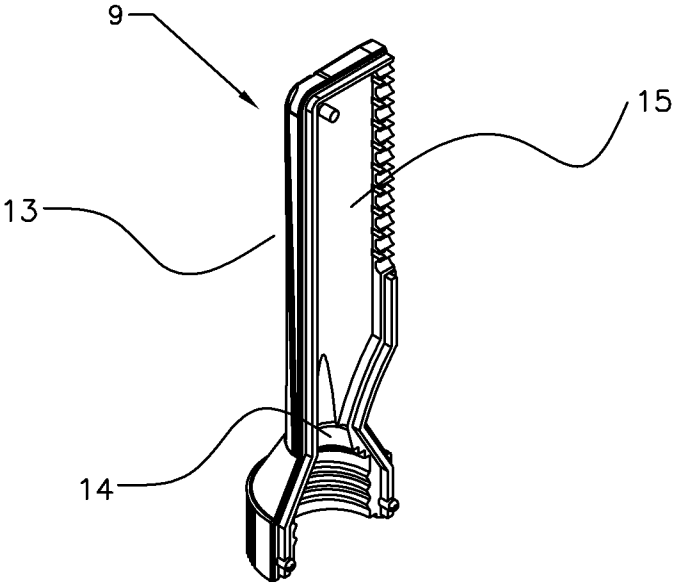
FIG. 5C is a perspective view of the second part of the applicator comb structure in FIGS. 5A and 5B.

As shown in FIG. 3, the applicator comb can be molded in two parts 8 and 9. As shown in FIGS. 4A-4C, the first part 8 incorporates the base 2, a first part 10 of the comb back 10*a*, the comb teeth 7 and one side 11 of the passage from the base 3*a* and one side of the manifold 12. As shown in FIGS. 5A-5C, the other part 9 is a closure for the first part 8 and includes the second part 13 of the comb back 10*a*, the other side 14 of the passage from the base 3*a* and the other side of the manifold 15. The two parts 8 and 9 are secured together by, for example, ultrasonic welding to complete the manifold and enclose it as well as the respective openings between adjacent teeth of the comb.

When the parts 8 and 9 are assembled, the openings between adjacent comb teeth project through a flat surface 16 that is parallel to the axis of the comb back and essentially perpendicular to both opposing outer side surfaces of each of the teeth. Opposing surfaces slope from both edges of the flat surfaces outwardly and toward the comb back. Accordingly, the combined surface between adjacent comb teeth is trapezoidal in a cross-section taken perpendicular to the axis of the comb back.

Comb applicators other than those described above can be mounted on the container in accordance with the present invention. Such applicator combs include those disclosed in U.S. Pat. Nos. 6,915,807; 6,588,433; 6,286,518; 6,112,751; 6,065,891; 5,337,764 and 3,446,216, as well as in U.S. Patent Application Publication No. 2005/0081871 A1, which are all incorporated herein by reference.

In accordance with the present invention, the type of container on which the applicator comb is mounted is not specifically limited, so long as the air oxidation hair dye composition can be expelled from the openings. Preferably, the container is a tube, which can be squeezed to propel the dye into the manifold and through the openings.

The container is also preferably designed to minimize the oxidation of the dye during storage. One example of such a container is disclosed in U.S. Pat. No. 7,052,752, which is incorporated herein by reference.

The air oxidation hair dye application system in accordance with the present invention preferably includes a removable barrier, such as a seal or a cap, which prevents air that can enter the applicator through the openings from coming into contact with the dye composition before the application of the dye is desired. When the dye is to be applied, this barrier is at least partially removed to allow the dye to be propelled through the openings in the applicator. After the application is complete, the barrier may be replaced to protect the remaining dye composition, if any, from premature oxidation.

In order to apply the hair dye in accordance with the present invention, the user would propel the dye through the manifold and the openings onto the hair. The comb may then be drawn through the hair to apply the dye to it in an even manner. Because the dye is essentially first exposed to air when it exits the openings 6 between the comb teeth, which is substantially immediately prior to application to the hair, in accordance with the present invention, premature oxidation of the dye is greatly reduced or minimized.

Various air oxidation hair dyes can be placed in the container and applied in accordance with the present invention. Suitable dyes include dye intermediates or precursors. Precursors known as "primary intermediates" produce colors when oxidized. Another class of precursors, known as "couplers" or "secondary intermediates", form reactive dye species when oxidized in the presence of a primary intermediate but, in general, do not produce any color when oxidized alone. The coupler is utilized to expand the color range by reaction with the primary intermediate, and may also be used to accelerate color formation. Oxidation dye precursors (primary intermediates and couplers) are described, for example, in Sagarin, "Cosmetic Science and Technology", Interscience, Special Edition, Volume 2, pages 308 to 310; and "The Chemistry of Synthetic Dyes", Volume 5, Academic Press, Inc., New York and London (1971).

Non-limiting examples of precursors suitable for use herein and which may function as primary intermediates are 1,4-diamino-benzene (p-phenylenediamine); 1,4-diamino-2-methyl-benzene (p-toluylenediamine); 1,4-diamino-2,6-dimethyl-benzene; 1,4-diamino-3,5-diethyl-benzene; 1,4-diamino-2,5-dimethyl-benzene; 1,4-diamino-2,3-dimethylbenzene; 2-chloro-1,4-diaminobenzene; 1,4-diamino-2-(thiophen-2-yl)benzene; 1,4-diamino-2-(thiophen-3-yl)benzene; 1,4-diamino-2-(pyridin-3-yl) benzene; 2,5-diaminobiphenyl; 1,4-diamino-2-methoxymethyl-benzene; 1,4-diamino-2-aminomethylbenzene; 1,4-diamino-2-hydroxymethyl-benzene; 1,4-diamino-2-(2-hydroxyethoxy)benzene; 2-(2-(acetylamino)ethoxy)-1,4-diaminobenzene; 4-phenylamino-aniline; 4-dimethylamino-aniline; 4-diethylamino-aniline; 4-dipropylamino-aniline; 4-[ethyl(2-hydroxyethyl)amino]-aniline; 4-[di(2-hydroxyethyl)amino]-aniline; 4-[di(2-hydroxyethyl)amino]-2-methyl-aniline; 4-[(2-methoxyethyl) amino]-aniline; 4-[(3-hydroxypropyl)amino]-aniline; 4-[(2, 3-dihydroxypropyl)amino-aniline; 1,4-diamino-2-(2-hydroxyethyl)-benzene; 1,4-diamino-2-(1-methylethyl)-benzene; 1,3-bis[(4-aminophenyl)(2-hydroxyethyl)amino]-2-propanol; 1,4-bis[(4-aminophenyl)amino]-butane; 1,8-bis (2,5-diaminophenoxy)-3,6-dioxaoctane; 4-amino-phenol; 4-amino-3 -methyl-phenol; 4-amino-3-(hydroxymethyl)-phenol; 4-amino-3-fluoro-phenol; 4-methylamino-phenol; 4-amino-2-(aminomethyl)-phenol; 4-amino-2-(hydroxymethyl)-phenol; 4-amino-2-fluorophenol; 4-amino-2-[(2-hydroxyethyl)-amino]methylphenol; 4-amino-2-methyl-phenol; 4-amino-2-(methoxymethyl)-phenol; 4-amino-2-(2-hydroxyethyl)-phenol; 5-amino-salicylic acid; 2,5-diamino-pyridine; 2,4,5,6-tetramine-pyrimidine; 4,5-diamino-1-1(2-hydroxyethyl)-1H-pyrazole; 4,5-diamino-1-(1-methylethyl)-1H-pyrazole; 4,5-diamino-1-[(4-methylphenyl)methyl]-1H-pyrazole; 1-[(4-chlorophenyl) methyl]-4,5 -diamino-1H-pyrazole; 4,5-diamino-1-methyl-1H-pyrazole; 2-aminophenol; 2 -amino-6-methylphenol; and 2-amino-5-methylphenol.

Non-limiting examples of couplers suitable for use herein are N-(3-dimethylamino-phenyl)-urea; 2,6-diamino-pyridine; 2-amino-4-[(2-hydroxyethyl)amino]anisole; 2,4-diamino-1-fluoro-5-methylbenzene; 2,4-diamino-1-methoxy-5-methylbenzene 2,4-diamino-1-ethoxy-5 -methyl-benzene; 2,4-diamino-1-(2-hydroxyethoxy)-5-methylbenzene; 2,4-di[(2-hydroxyethyl)amino]-1,5-dimethoxybenzene; 2,3-diamino-6-methoxy-pyridine; 3-amino-6-methoxy-2-(methylamino)pyridine; 2,6-diamino-3,5-dimethoxypyridine; 3,5-diamino-2,6-dimethoxy-pyridine; 1,3-diaminobenzene; 2,4-diamino-1-(2-hydroxyethoxy)benzene; 1,3-diamino-4-(2,3-hydroxypropoxy)benzene; 2,4-diamino-1,5-di(2-hydroxyethoxy)-benzene; 1-(2-aminoethoxy)-2,4-diaminobenzene; 2-amino-1-(2-hydroxyethoxy)-4-methylaminobenzene; 2,4-diaminophenoxyacetic acid ester; 3-[di(2-hydroxyethyl)amino]aniline; 4-amino-2-di[(2-hydroxyethyl)amino]-1 -ethoxy-benzene; 5-methyl-2-(1-methylethyl)phenol; 3-[(2-hydroxyethyl)amino]aniline; 3-[(2-aminoethyl)amino]aniline; 1,3-di(2,4-diaminophenoxy)propane; di(2,4-diaminophenoxy)methane; 1,3-diamino-2,4-dimethoxybenzene; 2,6-bis(2-hydroxyethyl)aminotoluene; 4-hydroxyindole; 3-dimethylaminophenol; 3-diethylaminophenol; 5-amino-2-methylphenol; 5-amino-4-fluoro-2 -methyl-phenol; 5-amino-4-methoxy-2-methylphenol; 5-amino-4-ethoxy-2 -methylphenol; 3-amino-2,4-dichlorophenol; 5-amino-2,4-dichlorophenol; 3-amino-2 -methyl-phenol; 3-amino-2-chloro-6-methylphenol; 3-aminophenol; 2-[(3-hydroxyphenyl)-amino]acetamide; 5-[(2-hydroxyethyl)amino]-4-methoxy-2-methylphenol; 5-[(2-hydroxyethyl)amino]-2-methylphenol; 3-[(2-hydroxyethyl)amino]-phenol; 3-[(2-methoxyethyl)amino]-phenol; 5-amino-2-ethyl-phenol; 5-amino-2-methoxyphenol; 2-(4-amino-2-hydroxyphenoxy)ethanol; 5-[(3-hydroxypropyl) amino]-2-methylphenol; 3-[(2,3-dihydroxypropyl)amino]-2-methylphenol; 3-[(2-hydroxyethyl)amino]-2-methylphenol; 2-amino-3-hydroxypyridine; 5-amino-4-chloro-2 -methylphenol; 1-naphthol; 2-methyl-1-naphthol; 1,5-dihydroxynaphthalene; 1,7 -dihydroxy-naphthalene; 2,3-dihydroxynaphthalene, 2,7-dihydroxy-naphthalene; 2-methyl-1 -naphthol-acetate; 1,3-dihydroxybenzene; 1-chloro-2,4-dihydroxy-benzene; 2-chloro-1,3-dihydroxy-benzene; 1,2-dichloro-2,4-dihydroxy-4-methylbenzene; 1,5-dichloro-2,4-dihydroxy-benzene; 1,3-dihydroxy-2-ethylbenzene; 3,4-methylenedioxy-phenol; 3,4-methylenedioxy-aniline; 6-bromo-1-hydroxy-3,4-methylenedioxybenzene; 3,4-diaminobenzoic acid; 3,4-dihydroxy-6-hydroxy-1,4(2H) benzoxazine; 6-amino-3,4-dihydro-1,4(2H)-benzoxazine; 3 -methyl-1-phenyl-5-pyrazolone; 5,6-dihydroxyindole; 5,6-dihydroxyindoline; 5-hydroxyindole; and 6-hydroxyindole.

The salt forms of the above-noted dye molecules that form stable salts may also be used. It should also be understood that the precursors described above are by way of example only and are not intended to be exhaustive of oxidative dyes suitable for use in accordance with the present invention.

Various commercially available oxidation dyes may be used. Some of these dyes include RODOL 4BXN (2-amino-4-hydroxyethylaminoanisole sulfate); RODOL 2A3PYR (2-amino-3-hydroxypyridine); RODOL 6CP (5 -amino-6-chloro-o-cresol); RODOL RED BN (4-hydroxypropylamino-3-nitrophenol); RODOL PAOX (2-methyl-5-hydroxyethyl aminophenol); RODOL HDAP (4,5 diamino-1-(2-hydroxyethyl)pyrazole sulfate); RODOL 6AMC (6 -amino-m-cresol); RODOL P BASE (p-aminophenol cosmetic grade); RODOL EG (m-aminophenol); RODOL 2G (o-aminophenol); RODOL BLFX (2,5 diamine toluene sulfate); RODOL ERN (1-Naphthol); RODOL RS TECH (resorcinol); RODOL D (p-phenylenediamine); HC YELLOW 4; HC YELLOW 5; HC BLUE 2 CP; RODOL BROWN 2R (2-nitro-p-phenylenediamine); RODOL 4A3NP (4-amino-3-nitrophenol); RODOL BROWN SO (2-chloro-p-phenylenediamine sulfate); RODOL CRS (4-Chlororesorcinol); RODOL 2MR (2-methylresorcinol high purity); RODOL GRAY BS (n-phenyl-p-phenylenediamine sulfate); RODOL PMP (1-phenyl-3-methyl-5-pyrazolone); RODOL PAOC (4-amino-2-hydroxytoluene); RODOL 3M4AP (4 -amino-m-cresol); RODOL GRAY HED (N,N-bis-hydroxyethyl-p-phenylenediamine sulfate); RODOL PS (p-aminophenol sulfate); RODOL EGS (m-aminophenol sulfate); RODOL DS (p-phenylenediamine sulfate); RODOL MPDS (m-phenylenediamine sulfate); RODOL 4JP (4-nitro-o-phenylenediamine); RODOL 9R BASE (2-amino-6-chloro-4-nitrophenol); RODOL PM (p-methylaminophenol sulfate); RODOL 2,4-DAPE (2,4 diaminophenoxyethanol dihydrochloride); JAROCOL DPE ($H_2SO_4$) (2,4-diaminophenoxyethanol sulfate); and any combination thereof. In particular, suitable combinations of a base, a precursor and a colorant are selected.

To prevent premature oxidation, it is typical for the dye composition to further comprise one or more antioxidants. Examples of antioxidants that can be used in accordance with the present invention include erythorbic acid and sodium sulfite.

The carrier component comprises water, and, optionally, one or more cosmetically acceptable solvents or diluents, for example the cosmetically acceptable alcohols and ethers, provided that such solvents and diluents are miscible with water and do not undesirably react with the other materials present in the developer component.

Preferably, the air oxidation dye composition in accordance with the present invention comprises one or more surfactants. Surfactants aid in the uniform distribution of the colorant composition on the hair surface and assist the user in rinsing the colorant composition from the hair subsequent to treatment. Various types of surfactants can be used.

Examples of cationic surfactants include amine-based surfactants, such as alkyl amines, alkylethoxy amines, ethoxylated alkyl amines, alkyl alkanol amines and cinnamido alkyl amine cationic quaternary salts, such as cinnamidopropyl trimethyl ammonium chloride. The term "amines" includes primary, secondary, tertiary and quaternary amines. Other cationic surfactant may be amidoamines, including $C_{12}$-$C_{22}$ alkyl or alkylethoxy mono, di and higher (poly)amidoamines, which can be ethoxylated or unethoxylated. Nonlimiting examples of such cationic surfactants are sodium dimethylaminopropyl coco-aspartamide, cocoamidopropyl dimethylamine, olivamidopropyl dimethylamine, soyamidopropyl dimethylamine, tallowamidopropyl dimethylamine, and stearamidoethyl dimethylamine.

Another class of surfactant that is suitable for use in the present invention is nonionic surfactants. This class includes long chain ($C_{12}$-$C_{22}$) fatty alcohols, mono, di and triglycerides and their derivatives, and alcohol ethoxylates. Nonlimiting examples include steareth 20, oleth 10, laureth 4, PEG-12 glyceryl dioleate, glycerol stearate, sorbitan oleate, and PPG-9 buteth-12.

Yet another suitable class of surfactants is anionic surfactants. This class includes alkyl and alkyl ether sulfates.

Preferably, the surfactants are very mild, skin-friendly and derived from natural ingredients. For example, coco glucoside, which is derived from coconut oil and fruit sugar, can act as an anionic surfactant and also smooth the hair structure to improve hair manageability.

To provide the alkaline conditions desired to promote oxidative dyeing, the compositions of this invention may further comprise at least one additional agent that provides an alkalizing effect. Examples of such alkalizing agents include, but are not limited to, ammonium hydroxide, alkali metal hydroxides and alkaline earth metal hydroxides; amines, such, alkanolamines, polyalkylene amines, heterocyclic amines; basic amino acids; and the like. Non-limiting examples of suitable alkalizing agents include ammonium hydroxide, sodium hydroxide, potassium hydroxide, magnesium hydroxide, calcium hydroxide, urea, ethylamine, dipropyl amine, triethylamine, 1,3-diaminopropane, monoethanolamine, diethanolamine, triethanolamine, aminomethyl propanol, dimethylaminoethanol, diethylenetriamine, morpholine, diethylaminoethanol, aminoalkylpropanediol, L-arginine, lysine, oxylysine, and histidine.

Desirably, the air oxidation hair dye compositions further comprise at least one thickening or gelling agent. Long chain fatty alcohols having up to about 22 carbon atoms in the long fatty chain can be thickener constituents in the compositions of this invention. Non-limiting examples of such fatty alcohols are lauryl alcohol, oleyl alcohol, myristyl alcohol, stearyl alcohol, and the like. Mixtures of fatty alcohols are also useful and are commercially available from numerous suppliers.

Thickening agents suitable for use herein may also be selected from long chain fatty acids having up to about 22 carbon atoms in the long fatty chain thereof. Non-limiting examples of such long chain fatty acids include oleic acid, stearic acid, myristic acid and linoleic acid. Mixtures of fatty acids are also useful and are commercially available from numerous suppliers.

The fatty alcohols and fatty acids described above may be in alkoxylated form. Such alkoxylates may contain an average of one to three, more particularly one to two, alkylene oxide, preferably ethylene oxide, units.

Other thickening or gelling agents, such as carbomers, conventionally used in hair coloring compositions may be present as optional ingredients in the compositions of this invention.

The air oxidation hair dye compositions in accordance with the present invention can include one or more chelating agents. The term "chelating agent" (or "chelant" or "sequestering agent") is well known in the art and refers to a molecule or a mixture of different molecules each capable of forming a chelate with a metal ion. A chelate is an inorganic complex in which a compound (chelant) is coordinated to a metal ion at two or more points so that there is a ring of atoms including the metals. Chelants contain two or more electron donor atoms that form coordination bonds with the metal ion.

As used herein, the term "chelant" includes all salts and derivatives comprising the same functional structure as the parent chelant they are referring to that have similar or better chelating properties. The term "derivatives" also includes "chelating surfactant" compounds (chelants modified to bear a surfactant moiety while keeping the same chelating functionality, see U.S. Pat. No. 5,284,972). The term "derivatives" also includes large molecules comprising one or more chelating groups having the same functional structure as the parent chelants. An example of these large molecules is polymeric EDDS (ethylenediaminedisuccinic acid).

Specific chelants that can be used include carboxylic acids (in particular aminocarboxylic acids), phosphonic acids (in particular aminophosphonic acids), and polyphosphoric acids (in particular linear polyphosphoric acids), their salts and derivatives.

Carboxylic acid chelants as defined herein are chelants having at least one carboxylic acid moiety (—COOH). Examples of aminocarboxylic acid chelants suitable for use herein include nitrilotriacetic acid and polyaminocarboxylic acids such as diethylenetriamine pentaacetic acid (DTPA), ethylenediamine disuccinic acid (EDDS), ethylenediamine diglutaric acid (EDGA), 2-hydroxypropylenediamine disuccinic acid (HPDS), glycinamide-N,N'-disuccinic acid (GADS), ethylenediamine-N—N'-diglutaric acid (EDDG), 2-hydroxypropylenediamine-N—N'-disuccinic acid (HPDDS), ethylenediaminetetraacetic acid (EDTA), dipicolinic acid (DPA), salts thereof and derivatives thereof. An example of a salt that can be used in the hair dye composition in accordance with the present invention is trisodium EDTA.

Other suitable aminocarboxylic chelants for use herein are iminodiacetic acid derivatives, such as N-2-hydroxyethyl N,N diacetic acid or glyceryl imino diacetic acid (described in EP 0 317 542 and EP 0 399 133), iminodiacetic acid-$N^2$-hydroxypropyl sulfonic acid and aspartic acid N-carboxymethyl N-2-hydroxypropyl-3-sulfonic acid (described in EP 0 516 102), alanine-N,N'-diacetic acid, aspartic acid-N,N'-diacetic acid, aspartic acid-N-monoacetic acid and iminodisuccinic acid chelants (described in EP 0 509 382), ethanoldiglycine acid, salts thereof and derivatives thereof.

Preferred aminocarboxylic chelants are diamine-N,N'-dipolyacid and monoamine monoamide-N,N'-dipolyacid chelants, salts thereof and derivatives thereof. Preferred polyacids contain at least two acid groups independently selected from the carboxylic acid group (—COOH), sulfonic group (—$SO_3H$), the o-hydroxyphenyl group, the m-hydroxyphenyl group and the p-hydroxyphenyl group. Suitable polyacids include diacids, triacids and tetraacids, preferably diacids. Preferred salts include alkali metal, alkaline earth, ammonium or substituted ammonium salts.

Exemplary diamine dipolyacids suitable for use herein include ethylenediamine-N,N'-disuccinic acid (EDDS), ethylenediamine-N,N'-diglutaric acid (EDDG), 2-hydroxypropylenediamine-N,N'-disuccinic acid (HPDDS), all disclosed in EP 0 687 292, ethylenedicysteic acid (EDC), disclosed in U.S. Pat. No. 5,693,854, diaminoalkyldi(sulfosuccinic acids) (DDS) disclosed in U.S. Pat. No. 5,472,642 and EDDHA (ethylenediamine-N—N'-bis(ortho-hydroxyphenyl acetic acid). A specific monoamine that can be used in the present invention is monoamide-N,N'-dipolyacid is glycinamide-N,N'-disuccinic acid (GADS), described in U.S. Pat. No. 4,983,315.

EXAMPLE

An experiment was conducted to compare the coloring achieved by applying an air oxidation hair dye composition from the container with a comb application in accordance with the present invention and by applying the same oxidizing dye in a conventional manner. In this experiment, hair coloring was performed under controlled conditions using three air oxidation hair dye compositions on 100% gray laboratory hair. The air oxidation dye compositions used are shown in Tables 1-3.

TABLE 1

| Light Brown | |
|---|---|
| Ingredient | Percent by Weight |
| Water | 89.61 |
| Antioxidant | 0.15 |
| Antioxidant/Preservative | 0.10 |
| Chelating Agent | 0.20 |
| Anionic Surfactant | 3.00 |
| Carbomer | 0.90 |
| Fragrance | 0.50 |
| Thickener/Gelling Agent | 2.00 |
| Cationic Surfactant | 0.01 |
| Air Oxidation Hair Dye Mixture (1,2,4-benzenetriol solution (solvents: isopropyl alcohol, isopropyl acetate, water and sulfuric acid); p-phenylenediamine; N,N-bis(2-hydroxyethyl)-p-phenylenediamine sulfate; p-aminophenol; 2,4-diaminophenoxy ethanol sulfate; and 2-methyl-5-hydroxyethylaminophenol) | 3.53 |

TABLE 2

| Medium Brown | |
|---|---|
| Ingredient | Percent by Weight |
| Water | 89.455 |
| Antioxidant | 0.150 |
| Preservative/Antioxidant | 0.100 |
| Chelating Agent | 0.200 |
| Anionic Surfactant | 3.000 |
| Carbomer | 0.950 |
| Fragrance | 0.500 |
| Thickener/Gelling Agent | 2.000 |
| Cationic Surfactant | 0.010 |
| Air Oxidation Hair Dye Mixture (1,2,4-benzenetriol solution (solvents: isopropyl alcohol, isopropyl acetate, water and sulfuric acid); p-phenylenediamine; N,N-bis(2-hydroxyethyl)-p-phenylenediamine sulfate; p-aminophenol and 2-methyl-5-hydroxyethylaminophenol) | 3.635 |

TABLE 3

| Dark Brown | |
|---|---|
| Ingredient | Percent by Weight |
| Water | 83.53 |
| Antioxidant | 0.15 |
| Antioxidant/Preservative | 0.10 |
| Chelating Agent | 0.20 |
| Anionic Surfactant | 3.00 |
| Carbomer | 1.00 |
| Fragrance | 0.50 |
| Thickener/Gelling Agent | 3.10 |
| Cationic Surfactant | 0.01 |
| Air Oxidation Hair Dye Mixture (1,2,4-benzenetriol solution (solvents: isopropyl alcohol, isopropyl acetate, water and sulfuric acid); p-phenylenediamine; N,N-bis(2-hydroxyethyl)-p-phenylenediamine sulfate p-aminophenol; 2-methyl-5-hydroxyethylaminophenol; 2-amino-4-hydroxyethylaminoanisole sulfate) | 8.41 |

Each hair dye composition was applied to the hair from the container in accordance with the present invention through the applicator comb, such as that shown in FIGS. 1-5C with all openings having the same diameter, so that the dye came into contact with the hair with no delay. Separately, each hair dye was applied to the hair after a 5 minute and a 10 minute delay. These delays represent the amount of time typically needed to apply an air oxidation hair dye composition from conventional containers without the comb applicator of the present invention. In all cases, the dye was allowed to develop on the hair for 5 minutes, followed by a rinse, shampoo and blow dry. Furthermore, dying under each condition was repeated.

The color of the swatches was recorded using a Minolta 508d Spectrophotometer using the Hunter "L, a, b" scale. "L" is a measure of lightness and varies from 100 for perfect white to zero for perfect black. "a" is a measure of redness, when the value of "a" is positive, and a measure of greenness, when negative. "b" is a measure of yellowness, when the value of "b" is positive, and a measure of blueness, when negative. The results from this experiment are shown below in Table 4.

TABLE 4

| Sample | "L" | "a" | "b" |
|---|---|---|---|
| Untreated White Hair | 72.4 | −1.7 | 13.4 |
| Light Brown | | | |
| No delay, swatch 1 | 44.9 | 2.0 | 3.1 |
| No delay, swatch 2 | 46.2 | 2.2 | 3.2 |
| 5 minute delay, swatch 1 | 48.8 | 1.6 | 3.9 |
| 5 minute delay, swatch 2 | 48.8 | 1.6 | 4.0 |
| 10 minute delay, swatch 1 | 52.2 | 1.4 | 5.1 |
| 10 minute delay, swatch 2 | 51.6 | 1.4 | 5.5 |
| Medium Brown | | | |
| No delay, swatch 1 | 48.8 | 2.2 | 4.0 |
| No delay, swatch 2 | 48.6 | 2.0 | 4.9 |
| 5 minute delay, swatch 1 | 53.4 | 1.2 | 6.0 |
| 5 minute delay, swatch 2 | 53.2 | 1.1 | 5.8 |
| 10 minute delay, swatch 1 | 52.1 | 1.3 | 6.1 |
| 10 minute delay, swatch 2 | 52.0 | 1.5 | 6.3 |
| Dark Brown | | | |
| No delay, swatch 1 | 40.9 | 2.0 | 3.1 |
| No delay, swatch 2 | 40.3 | 2.0 | 3.3 |
| 5 minute delay, swatch 1 | 44.8 | 2.0 | 3.1 |
| 5 minute delay, swatch 2 | 47.5 | 1.5 | 4.6 |
| 10 minute delay, swatch 1 | 50.2 | 0.9 | 5.1 |
| 10 minute delay, swatch 2 | 49.5 | 0.9 | 5.1 |

Based on the "L, a, b" scale, the differences in lightness are apparent to the human eye at a change of about 0.5. Therefore, according to the results shown in Table 4, it is readily evident that both the 5 and 10 minute delay between dispensing and applying to the hair the air oxidation hair dye composition produce visually lighter, i.e., inferior, results. Therefore, application of an air oxidation hair dye composition in accordance with the present invention produces markedly superior hair coloring results compared with conventional air oxidation hair dye application.

While the invention has been described in conjunction with the detailed description thereof and the accompanying figures, the foregoing description is intended to illustrate and not limit the scope of the invention, which is defined by the scope of the appended claims. Other aspects, advantages, and modifications are within the scope of the following claims.

What is claimed is:

1. An air oxidation hair dye application system comprising:

a container, an inside of which consists of walls surrounding an air oxidation hair dye composition contained in the container; and an applicator in a form of a comb having comb teeth, which projects from a base, mounted directly on the container, wherein the applicator is in fluid communication with the inside of the container and is capable of receiving the air oxidation hair dye composition from the container, and wherein an inside of the applicator consists of:

a passage in the base;

an internal manifold, which is a space surrounded by walls, that is in fluid communication with the inside of the container through the passage in the base and that receives the air oxidation hair dye composition from the container; and a plurality of openings exposed to air, which are in fluid communication with the space of the manifold, which are between adjacent said comb teeth, and through which the air oxidation hair dye composition is dispensed from the applicator.

2. The system according to claim 1, wherein the applicator is detachably mounted on the container.

3. The system according to claim 2, wherein the applicator is detachably mounted on the container via a thread.

4. The system according to claim 1, wherein the comb is formed with a flat surface that is parallel to a longitudinal axis of the applicator and substantially perpendicular to both opposing outer side surfaces of each comb tooth, and wherein the openings project through the flat surface.

5. The system according to claim 4, wherein the opposing outer side surfaces slope outwardly and toward a back of the applicator, so that a combined surface between adjacent comb teeth is trapezoidal in a cross-section taken perpendicular to the longitudinal axis of the applicator.

6. The system according to claim 1, wherein the openings are substantially circular and have a diameter from about 1.3 mm to about 1.9 mm.

7. The system according to claim 1, wherein each of the openings has the same diameter.

8. The system according to claim 1, wherein the container is a tube.

9. The system according to claim 1, wherein the openings are along a longitudinal axis of the applicator.

10. The system according to claim 1, wherein inner ends of the comb teeth project into the internal manifold.

11. The system according to claim 1, wherein an upper portion of the container is inside the passage.

12. A method for coloring hair comprising applying to the hair, from the air oxidation hair dye application system according to claim 1, the air oxidation hair dye composition through the openings in the applicator.

13. The method according to claim 12, further comprising combing the air oxidation hair dye composition through the hair using the applicator.

14. The method according to claim 12, further comprising combing the hair with the applicator while performing the applying of the air oxidation hair dye composition to the hair through the openings in the applicator.

15. An air oxidation hair dye application system kit comprising:

a container, an inside of which consists of walls surrounding an air oxidation hair dye composition contained in the container, the container covered with at least one of a cap and a seal; and an applicator in a form of a comb having comb teeth, which projects from a base, configured to be mountable directly on the container after removal of the at least one of the cap and the seal, wherein an inside of the applicator consists of:

a passage in the base;

an internal manifold, which is a space surrounded by walls, that is in fluid communication with the inside of the container through the passage in the base and is capable of receiving the air oxidation hair dye composition from the container when the applicator is mounted on the container; and a plurality of openings exposed to air between adjacent said comb teeth through which the air oxidation hair dye composition is dispensed from the applicator, and the openings are in fluid communication with the inside of the container when the applicator is mounted on the container.

16. The kit according to claim 15, wherein the applicator is detachably mountable on the container.

17. The kit according to claim 16, wherein the applicator is detachably mountable on the container via a thread.

18. The kit according to claim 15, wherein the comb is formed with a flat surface that is parallel to a longitudinal axis of the applicator and substantially perpendicular to both opposing outer side surfaces of each comb tooth, and wherein the openings project through the flat surface.

19. The kit according to claim 18, wherein the opposing outer side surfaces slope outwardly and toward a back of the applicator, so that a combined surface between adjacent comb teeth is trapezoidal in a cross-section taken perpendicular to the longitudinal axis of the applicator.

20. The kit according to claim 15, wherein the openings are substantially circular and have a diameter from about 1.3 mm to about 1.9 mm.

21. The kit according to claim 15, wherein each of the openings has the same diameter.

22. The kit according to claim 15, wherein the container is a tube.

23. The kit according to claim 15, wherein the openings are along a longitudinal axis of the applicator.

24. The kit according to claim 15, wherein inner ends of the comb teeth project into the internal manifold.

25. The kit according to claim 15, wherein the applicator is detachably mountable on the container such that an upper portion of the container is inside the passage.

26. A method for coloring hair comprising:

providing the air oxidation hair dye application system kit according to claim 15;

mounting the applicator on the container; and applying the air oxidation hair dye composition to the hair through the openings in the applicator.

27. The method according to claim 26, further comprising combing the air oxidation hair dye composition through the hair using the applicator.

28. The method according to claim 26, further comprising combing the hair with the applicator while performing the applying of the air oxidation hair dye composition to the hair through the openings in the applicator.

* * * * *